United States Patent [19]

Ashton

[11] 4,161,872

[45] Jul. 24, 1979

[54] ROLLING MILLS

[75] Inventor: John C. Ashton, Gamston, near Retford, England

[73] Assignee: Ashlow Steel & Engineering Company, Limited, Sheffield, England

[21] Appl. No.: 866,614

[22] Filed: Jan. 3, 1978

[30] Foreign Application Priority Data

Jan. 7, 1977 [GB] United Kingdom ..... 597/77

[51] Int. Cl.[2] ..... B21B 19/02

[52] U.S. Cl. ..... 72/95; 72/78

[58] Field of Search ..... 72/78, 95, 96, 97, 98, 72/99, 100; 29/122

[56] References Cited

U.S. PATENT DOCUMENTS 600,144 3/1898 Donaghy et al. ..... 72/97

1,736,099 11/1929 Stiefel ..... 72/97

3,908,420 9/1975 Biswas et al. ..... 72/78

*Primary Examiner*—Lowell A. Larson

*Attorney, Agent, or Firm*—Oblon, Fisher, Spivak, McClelland & Maier

[57] ABSTRACT

There is disclosed a rolling mill comprising a pair of generally discus shaped rolling heads affording opposed rolling surfaces, the rolling surface of each head being provided by its surfaces inclined at a substantial angle to the axis of rotation of the rolling head, the rolling heads being mounted so that their axes of rotation are in parallel planes spaced apart from one another, the axes of rotation of the rolling heads being inclined to one another, and drive means arranged to be capable of rotating the rolling surfaces of the heads in opposite senses relative to each other and at different speeds.

1 Claim, 6 Drawing Figures

ROLLING MILLS

Figure 1:
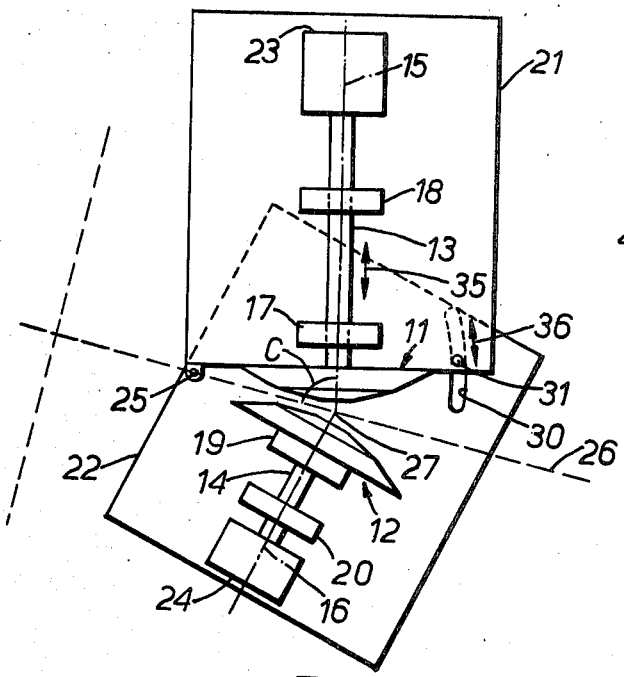

The present invention relates to rolling mills and in particular those used for rolling billets into bars or rods.

Conventionally this is done by having a long line of roll stands each of which reduce the thickness of a red hot billet by up to 30%. Thus to achieve substantial reductions in thickness a large number of stands are needed. These occupy a lot of space and the roll speeds have to be carefully related to each other gradually increasing down the length of the rolling mill.

In addition, with normal grooved cylindrical rolls the billet is first rolled to an oval cross section then twisted through 90° and rolled back to a circular cross section. This means that at least two roll stands are always required.

The present invention is concerned with producing more compact rolling mills than hitherto known which can also produce much greater reductions in thickness and which obviate the need for twisting mechanisms.

British Patent specification No. 1240149 (Siemag) discloses a rod mill having an arrangement of three conical rolling heads mounted for simultaneous rotation in a planetary movement about the pass line of the mill whilst the rolling heads each rotate at the same speed and in the same direction.

This has the disadvantage that the rolls have to be of identical size and have to be changed if any wear occurs; moreover the area of the rolls at which rolling occurs is very limited and thus the rate of wear is high.

According to the present invention, a rolling mill comprises a pair of generally discus shaped rolling heads affording opposed rolling surfaces, the rolling surface of each head being provided by its surfaces inclined at a substantial angle to the axis of rotation of the rolling head, the rolling surfaces preferably being made up of at least two frustoconical surfaces inclined at a substantial angle to the axis of rotation of the rolling head, the rolling heads being mounted so that their axes of rotation are in parallel planes spaced apart from one another, the axes of rotation of the rolling heads being inclined to one another, the mounting preferably being such that the angle of inclination of the rolling heads can be varied and the separation of the rolling heads can also be varied and drive means arranged to be capable of rotating the rolling surfaces of the heads in opposite senses relative to each other and at different speeds.

The arrangement in accordance with the present invention enables much larger rolls to be used thus increasing roll life. Also because the rolls can be rotated at different speeds the rolls do not have to be of identical size. Minor variations in original manufacturing dimensions or in wear can be accomodated by adjustment of the rates of rotation of the rolling heads. Thus even when the rolls are mounted for rotation about the pass line as described below, the rate of rotation of each head can still be individually controlled.

The separation between the plane in which lie the axes of rotation of the rolling heads is preferably also adjustable.

The invention also includes a method of rolling a workpiece, e.g. a billet, of material in a plastic state, e.g. red hot steel, which comprises rotating rolling heads, shaped and positioned as defined above, in opposite senses at substantially the same speed, feeding the billet in a direction generally parallel to the planes in which lie the axes of rotation of the heads and between the said rolling heads from the side where the rolling surfaces are closer to each other, and adjusting the relative speed of rotation of the rolls so that the workpiece rotates between the rolls and emerges as a rod of circular and reduced cross section on the other side of the rolls. The original size of the workpiece, the separation of the rolling head and the exact position at which it is fed in, will all need to be taken into account in adjusting the relative speeds of the rolling heads.

The workpiece will emerge rotating about its longitudinal axis, which is the pass line of the mill. It may be wished to compensate for this rotation, e.g. so as to feed the workpiece directly to a subsequent fabrication or treatment stage. This can be done by mounting the arrangement described above for rotation about the pass line and providing drive means and control means whereby the assembly can be rotated in the opposite sense to the rotation imparted to the workpiece by the rolling heads, at the same speed or a closely similar speed.

Figure 2:
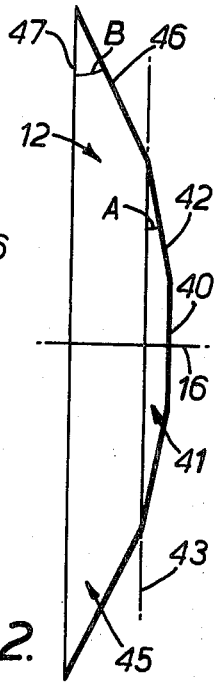
Figure 3:
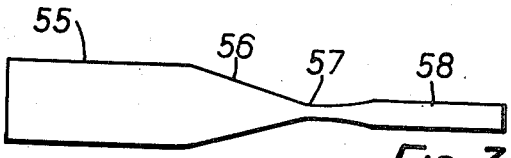
Figure 4:
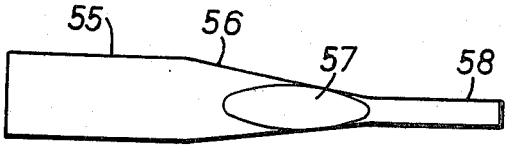
Figure 5:
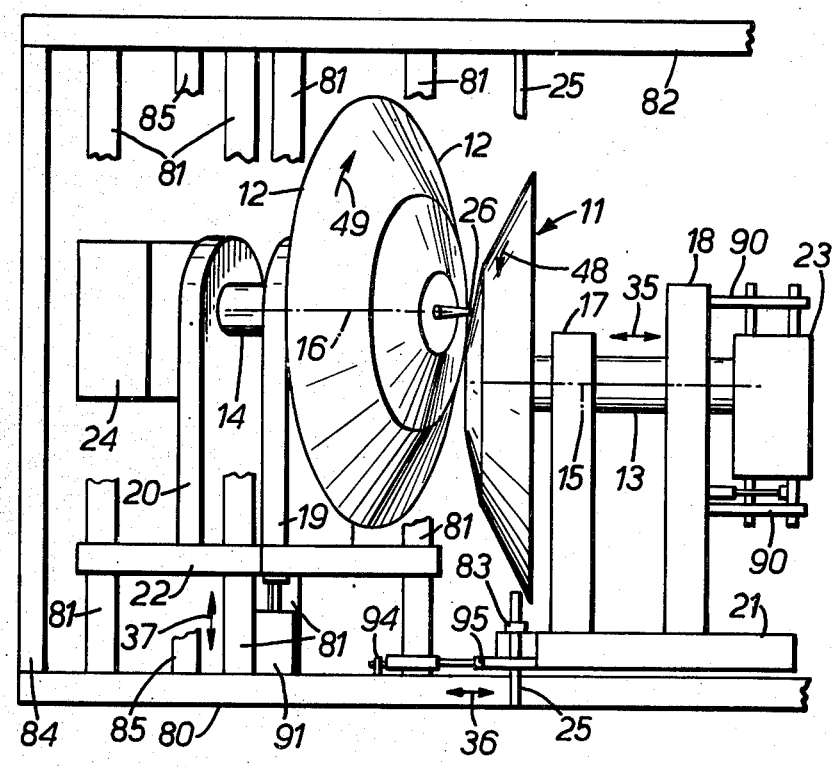

The present invention may be put into practice in various ways and one specific embodiment and a modification thereof will be described by way of example with reference to the accompanying diagrammatic drawings in which;

FIG. 1 is a diagrammatic plan view of a first embodiment of the invention,

FIG. 2 is a side elevation on a larger scale of one of the rolling heads shown in FIG. 1, FIG. 3 is a side elevation showing the deformation undergone by a workpiece as it passes through the heads shown in FIG. 1, on a yet larger scale, FIG. 4 is a side elevation on the workpiece of FIG. 3 rotated through 90°, and FIG. 5 is an end elevation from a view edge on to one of the rolling heads shown in FIG. 1 and from the outlet side; it is of a modified form of the arrangement of FIG. 1 but shows the layout of the heads shown in FIG. 1 and is on the same scale as FIG. 2.

Figure 6:
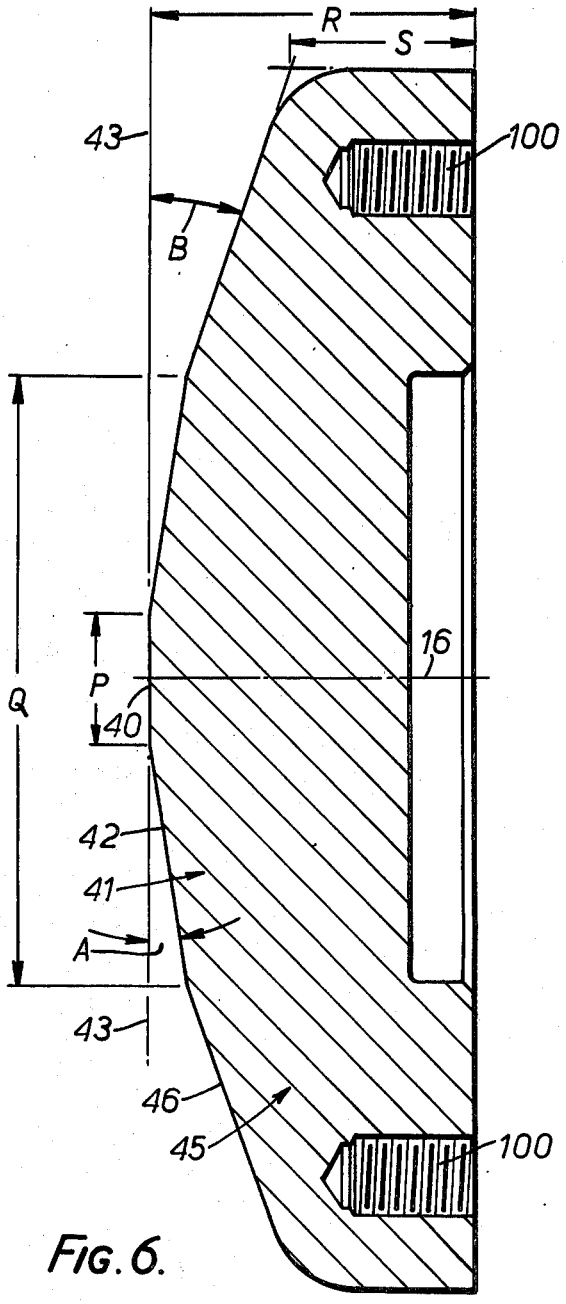

FIG. 6 is a view similar to FIG. 2 in cross section of a preferred form of rolling head.

Referring now to FIG. 1, two rolling heads 11 and 12 are mounted on drive shafts 13 and 14 extending along the axes of rotation 15 and 16 of the heads.

The drive shafts are mounted in bearings 17, 18 and 19, 20 respectively which in turn are mounted on support plates 21 and 22. Each drive shaft 13 and 14 is provided with separately controllable drive motors 23 and 24, each provided with its own appropriate power supply and controls.

The motors may be electrically or hydraulically driven.

The support plates as can be seen in FIG. 5 are spaced apart from one another, preferably so that the axis of one head is opposite the shallower frustoconical region of the other head. In the arrangement shown in FIG. 1 they are pivoted to each other by a pivot 25 which is perpendicular to the planes of the support plates. The pivot is located on the pass line 26 which passes equidistantly between the heads 11 and 12 through the intersection 27 of the axes of rotation 15 and 16 of the rolling heads. The angle between the heads can thus be adjusted as indicated by the arrow 36 whilst the pass line 26 will always pass through the intersection 27. The angle can be set by an arrangement of a slot 30 and locking nut 31.

The bearings 17 and 18 are preferably positioned so that the head 11 can be advanced or withdrawn from the head 12 along its axis of rotation 15 as indicated by the arrow 35.

The head 12 is preferably also moveably mounted, but in this case so as to be movable in a direction parallel to the axis 25 of the pivot as indicated by the arrow 37 in FIG. 5.

The shape of the rolling head is thought to be critical.

The head shown in FIG. 2 is generally discus shaped, but instead of having a curved surface, the rolling surface has three flat regions. It has a central flat circular region 40 through which the axis of rotation passes. It has an axially thin frustoconical region 41, the angle A of the outer surface 42 of which to a line 43 perpendicular to the axis 16 is in the range 5 to 15° e.g. 7 to 10° .

It also has an axially thicker frustoconical region 45 the angle B of the outer surface 46 of which to a line 47 perpendicular to the axis 16 is in the range 10° to 30° e.g. 15° to 20° , the angle B being greater than the angle A.

The rear face of the rolling heads may be constituted by the line 47 but there is preferably an integral or separate reinforcing or backing plate.

The heads 11 and 12 are arranged to rotate in opposite directions, the head 11 as indicated by the arrow 48 in FIG. 5 towards the output side of the device and the head 12 as indicated by the arrow 49 towards the input side.

The heads as can be seen in FIG. 5 are arranged so that their axis 15 and 16 lie in planes which are parallel to each other, but the axis 16 of head 12 lies above the axis 15 of head 11, so that the region 40 of head 12 is juxtaposed to the surface 42 of head 11. It will be appreciated that the intersection 27 is a line perpendicular to the axes 15 and 16 of the heads and not a point at which the axes meet because the axes are in spaced apart parallel planes.

FIGS. 3 and 4 show the changes in shaped undergone by a plastic material on passing between the heads 11 and 12 along the pass line 26.

The workpiece is initially of circular cross section at 55, it the passes through a frustoconical region 56 and then a flattened or waisted region 57 and then finally to a circular region 58 of about ¼ its original diameter. The final diameter is determined by the separation of the heads at the point from which the workpiece emerges between them.

This, in turn, is determined by the absolute separation of the rolls, their angle to each other which can be expressed as the angle C, which the axis 15 or 16 of each roll makes to the pass line 26, and their absolute speeds of rotation, D for rolling head 11; E for rolling head 12 and relative speed of rotation.

The angle C is preferably in the range 60° to 85° . Suitable rates of rotation, D and E are in the range 50 rpm to 500 rpm for a six inch diameter rolling head, D and E are preferably substantially the same e.g. in the range 2:1 to 1:2.

The contrarotation of the rolling heads causes the workpiece to be rotated around the axis of the pass line. For rolling small workpieces e.g. 100 lb billets to ¼" diameter the rotation of the workpiece can be tolerated by feeding the material into a holding area and when the billet is fully rolled feeding the rod into the next stage of the rolling process. However where it is wished to feed the output from this rolling machine directly into a further processing step it may be desirable to compensate for the rotation imparted to the workpiece preferably to such an extent that the workpiece no longer rotates as it emerges from the machine.

This can be done by mounting the heads so that they can be rotated around the axis of the pass line at a speed which matches and is in the opposite sense to the rotation imparted to the workpiece by the heads themselves.

The arrangement shown in FIG. 5 whilst basically concerned with the same embodiment as that shown in FIG. 1 contains a number of modifications which facilitate this mode of using the rolling heads.

Thus the support plates 21 and 22 are themselves mounted on a base plate 80, the plate 21 by the pivot 25 and the plate 22 slideably on four support rods 81 which are mounted perpendicularly to the base plate 80 and extend up and are secured to a top support plate 82. The pivot can also extend up to the top plate 82, the plate 21 being held adjustably in position by a locking nut 83.

The rods 81 are shown partly cut away so as to not interfere with the drawings.

Each corner of the plate 80 is joined to the respective corner of the plate 82 disposed perpendicularly to it by a side frame member 84, 85 (shown partly cut away) and 86 and 87 (both not shown). This box shaped framework can then be secured to a turntable 88 (not shown) which is perpendicular to the pass line 26 and which has an aperture surrounding the pass line and is mounted for rotation about the pass line. This mounting table can carry electric slip rings or hydraulic rotary joints for feeding power to the motors 23 and 24 and to the control circuitry and control motors carried on the turntable.

Thus an hydraulic or pneumatic cylinder or solenoid motor 91 can be disposed between the base plate 80 and the support plate 22 to permit the vertical position of the axis 16 of the rolling heads 12 to be adjusted in relation to the pass line 26.

The plate 21 may be provided with two fixed bearings 17 and 18 spaced so that the head 11 can be moved along its axis 13 in the sense of the arrow 35.

This can be achieved by mounting support rods between the bearing 18 and the side frames 86 and 87 and mounting the motor 23 on these rods 90 and locating a pneumatic or hydraulic cylinder or solenoid motor between the bearing 18 and the motor 23 or its mountings on the rods 90.

The angular relationship between the heads 11 and 12 can be adjusted by means of a pneumatic or hydraulic cylinder or solenoid motor 93 pivoted at its free end 94 to the base plate 80 and having the free end of its piston pivoted at 95 to the plate 21.

FIG. 6 shows a preferred form of rolling head. It has the same arrangement of rolling surfaces 42 and 46 as the head shown in FIG. 2 but has an integral backing plate provided with screwthreaded holes by which it can be bolted to a support plate attached to the drive shaft 13 or 14.

The angle A is 10° and the angle B is 20° . The diameter P of the region 40 is 20 units, the diameter Q of the region 41 is 100 units, the thickness of the head R is 55 units and the thickness of the backing plate is 30 units.

In an alternative embodiment the rolling heads may be mounted and driven in a planetary gear arrangement for example of the type disclosed in British patent specification No. 1,240,149.

In a further modification (not shown) upper and lower inlet and outlet guides (which may be replaceable by guides of different dimensions) are provided. These may be provided by tubular guides or roller guides.

They may have lengths in the range 0.1 to 1 times the diameter of a rolling head. The diameter of the outlet guide is preferably in the range 1.1 to 2.0 times the diameter of the billet after rolling.

In a further modification the guides are provided with sensing means to sense any upward or downward tendency of the rolled billet away from the pass line, and to supply a correction signal to the controls or motors for the rolling heads so as to correct this tendency. The guides may be movably mounted and provided with limit switches, pressure transducers or other appropriate sensors.

Optical sensing may also be utilized in addition to or instead of the guides so as to provide a correction signal.

It will be appreciated that the rolls in FIG. 1 have been shown mounted in vertical planes and the arrangement has been described in this sense. Clearly the rolls could be mounted in other planes e.g. above and below the pass line which would remain in a horizontal plane.

What we claim as our invention and desire to secure by Letters Patent is:

1. A rolling mill comprising:

a pair of generally discus shaped rolling heads each having an axis of rotation and affording opposed rolling surfaces, each said rolling surfaces being inclined at a substantial angle to its said axis of rotation, said axes of rotation lying in spaced parallel planes and said axes of rotation being inlined to one another about a third axis perpendicular to said planes;

means for varying the spacing between said spaced parallel planes;

means for varying the angle of inclination of said rolling heads about said third axis;

means for varying the separation of said rolling heads; and drive means for said rolling heads, said drive means adapted to be capable of rotating said rolling surfaces of said heads in opposite senses relative to each other and at different speeds.

* * * * *

UNITED STATES PATENT AND TRADEMARK OFFICE

CERTIFICATE OF CORRECTION

PATENT NO. : 4,161,872

DATED : July 24, 1979

INVENTOR(S) : John C. Ashton

It is certified that error appears in the above–identified patent and that said Letters Patent are hereby corrected as shown below:

Please insert the following priority data:
[30] -- Jan. 7, 1977 [GB] United Kingdom ... 579/77 --
and delete " Jan. 7, 1977 [GB] United Kingdom ... 597/77"

Signed and Sealed this

Sixth Day of November 1979

[SEAL]

*Attest:*

RUTH C. MASON
*Attesting Officer*

LUTRELLE F. PARKER
*Acting Commissioner of Patents and Trademarks*